United States Patent [19]

Adams et al.

[11] Patent Number: 4,587,982

[45] Date of Patent: May 13, 1986

[54] TIPPING ASSEMBLY FOR AN ELONGATE SMOKING ARTICLE

[75] Inventors: Peter I. Adams, Abbots Leigh; Raymond A. Bryant, Yatton; William Knapman, Banwell, all of England

[73] Assignee: Imperial Group PLC, London, England

[21] Appl. No.: 449,771

[22] Filed: Dec. 14, 1982

[30] Foreign Application Priority Data

Dec. 23, 1981 [GB] United Kingdom ..... 8138670

[51] Int. Cl.[4] ..... A24D 3/04; A24D 3/02

[52] U.S. Cl. ..... 131/336; 131/339; 131/361

[58] Field of Search ..... 131/336, 361–363, 131/339

[56] References Cited

U.S. PATENT DOCUMENTS

| | | | |
|---|---|---|---|
| 3,490,461 | 1/1970 | Osmalov et al. | 131/336 |
| 3,733,246 | 5/1973 | Thomson et al. . | |
| 3,805,800 | 4/1974 | Summers . | |
| 4,338,956 | 7/1982 | Sanford et al. | 131/361 |
| 4,362,172 | 12/1982 | Johnson | 131/336 |

FOREIGN PATENT DOCUMENTS

| | | |
|---|---|---|
| 1308661 | 2/1973 | United Kingdom . |
| 1358685 | 7/1974 | United Kingdom . |
| 1411029 | 10/1975 | United Kingdom . |
| 1439705 | 6/1976 | United Kingdom . |
| 1555252 | 11/1979 | United Kingdom . |

*Primary Examiner*—Vincent Millin
*Assistant Examiner*—H. Macey
*Attorney, Agent, or Firm*—Larson and Taylor

[57] ABSTRACT

A cylindrical filter element for a cigarette is wrapped in a ventilated tipping wrapper which is spaced from the filter element by a raised pattern of thermoplastic material printed on the inner surface of the wrapper. The pattern is designed to provide air channels communicating with the ventilations in the wrapper and leading to the mouth end of the filter. This enables the manufacturer to dispense with a separate spacing member which has hitherto been located between the filter and the tipping wrapper. The invention includes a method of making a filter element including such a raised pattern.

15 Claims, 5 Drawing Figures

TIPPING ASSEMBLY FOR AN ELONGATE SMOKING ARTICLE

BACKGROUND OF THE INVENTION

This invention relates to a tipping assembly for an elongate smoking article such as a cigarette in which the tipping assembly is provided with ventilation means adapted to provide a flow of ventilating air to the smoker's mouth.

Examples of such tipping assemblies, especially in relation to cigarettes, are described in our published British patent application No. 2090117A. In application 2090117A there is described a tipping assembly comprising a ventilated tipping wrapper surrounding a cylindrical plug element but spaced therefrom by spacing means which define channels extending to the mouth end of the tipping assembly, the channels communicating with the ventilated regions of the tipping wrapper. The spacing means is typically a sheet of plug wrapper, or similar material, which has longitudinal channels cut in it to provide the defined channels referred to above.

The tipping assembly of 2090117A will hereinafter be referred to as: "of the type described". Advantages of this manner of ventilation are set out in detail in application 2090117A which is incorporated herein by reference.

The tipping assembly of the type described is efficient in production and use. However, if it is desired to change the ventilation requirements of the assembly it may be necessary to prepare and load into the filter making machine a new reel of channelled plug wrap material. The design and manufacture of such a new reel of plug wrap material is time-consuming and expensive, especially if the changed ventilation requirements are needed only for a short production run.

SUMMARY OF THE INVENTION

The present invention is concerned with an improved means for spacing the tipping wrapper in the tipping assembly of the type described radially from the plug element, the improvement having certain economic advantages and ease of manaufacture of the spacing means in the tipping assembly of the type described, especially when it is necessary to vary the ventilation requirements relatively cheaply and at short notice.

According to a first aspect of the present invention there is provided a tipping assembly for an elongate smoking article comprising, a cylindrical filter element and a ventilated tipping wrapper surrounding but spaced radially from the filter element, the tipping wrapper having raised markings printed on the surface facing the filter element, the markings being arranged to space the tipping wrapper from the filter element and to define air channels extending longitudinally to a mouth end of the assembly, the arrangement being such that in use air passes through the ventilated tipping wrapper into the channels.

According to a second aspect of the present invention there is provided a method of making spacing means for a tipping assembly of the type described, the method comprising applying to a web of tipping wrapper material by means of a printing technique a raised pattern of predetermined configuration consisting of a plurality of discrete printed markings, and controlling the thickness of the markings relative to the surface of the web to a predetermined thickness.

According to one embodiment of the invention the printing technique may be a rotary screen process. According to another embodiment of the invention the printing technique may be a gravure process.

The advantages offered by the invention are that the manufacturer of cigarette filter assemblies of the type described is able to modify the characteristics of the ventilation relatively easily and economically without having to design and cut out channels in the spacing sheet of the tipping assembly of the type described.

BRIEF DESCRIPTION OF THE DRAWINGS

The invention will now be described by way of example only with reference to the accompanying schematic drawings which are not to scale, as follows.

DESCRIPTION OF THE PREFERRED EMBODIMENTS

Figure 5:
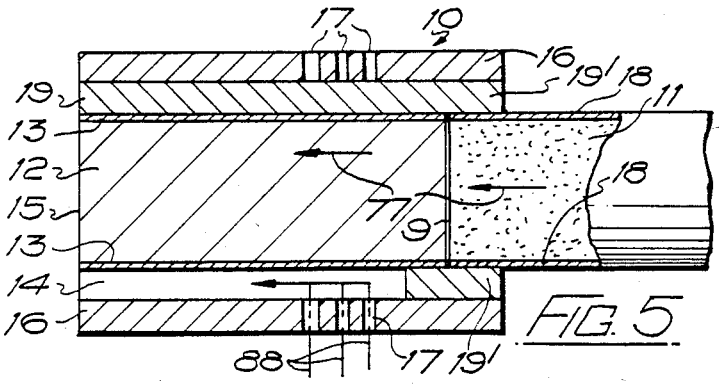

Referring first to FIG. 5 there is shown a cylindrical tipping assembly 10 attached to a tobacco rod 11. The tipping assembly 10 comprises, (a) A smooth surfaced cylindrical filter plug 12 of cellulose acetate tow in abutment to one end (9) with the tobacco rod 11.

(b) A tubular plug wrapper 13 of paper enclosing the cylindrical surface of the filter plug 12. The plug wrapper is impervious to air.

(c) A tipping wrapper 16 surrounding but spaced radially from the plug wrapper 13. The tipping wrapper 16 substantially overlaps the tobacco rod 11 which is enclosed in a cigarette paper wrapping 18.

(d) Spacing means 19 which space the tipping wrapper 16 from the plug wrapper 13 and define the longitudinal channels 14 (only one of which is shown) extending from the mouth end 15 of the plug towards but not to the tobacco rod end (9) of the plug. At the tobacco rod end 9 the spacing means 19 extends completely round the plug 16, as shown at 19', and overlaps the tobacco rod 11.

The spacing means 19 is provided by raised areas or markings of polyvinyl acetate printed on that surface of the tipping wrapper 16 facing the plug 12. Typically, the printed polyvinyl acetate areas are about 0.020 cm thick, and the tipping wrapper paper is about 0.0038 cm thick. The channels 14 are consequently about 0.020 cm deep. The printed polyvinyl acetate areas are arranged so that the ventilation holes 17 communicate with the channels 14. Ventilation air is thus able to move along path 88 through ventilation holes 17, through channels 14, to the mouth end of the filter. The polyvinyl acetate contains inert fillers to control its rheological properties and thus to ensure that an even and sharply defined printed deposit is made on the tipping wrapper 16.

It will be understood that FIG. 5 is diagrammatic and not to scale. The relative dimensions of the components of the tipping assembly have been exaggerated for the sake of clarity. In practice, a manufacturer may wish to take steps to avoid an unsightly lip between the tipping assembly and the remainder of the smoking article. One way of achieving this is to reduce the diameter of the plug compared with that of the tobacco rod. Another way, perhaps in conjunction with the first way, is to bring the tipping wrapper 16 into contact with the tobacco rod 18 by overlapping. Other methods will occur to the man skilled in the art.

Figure 1:
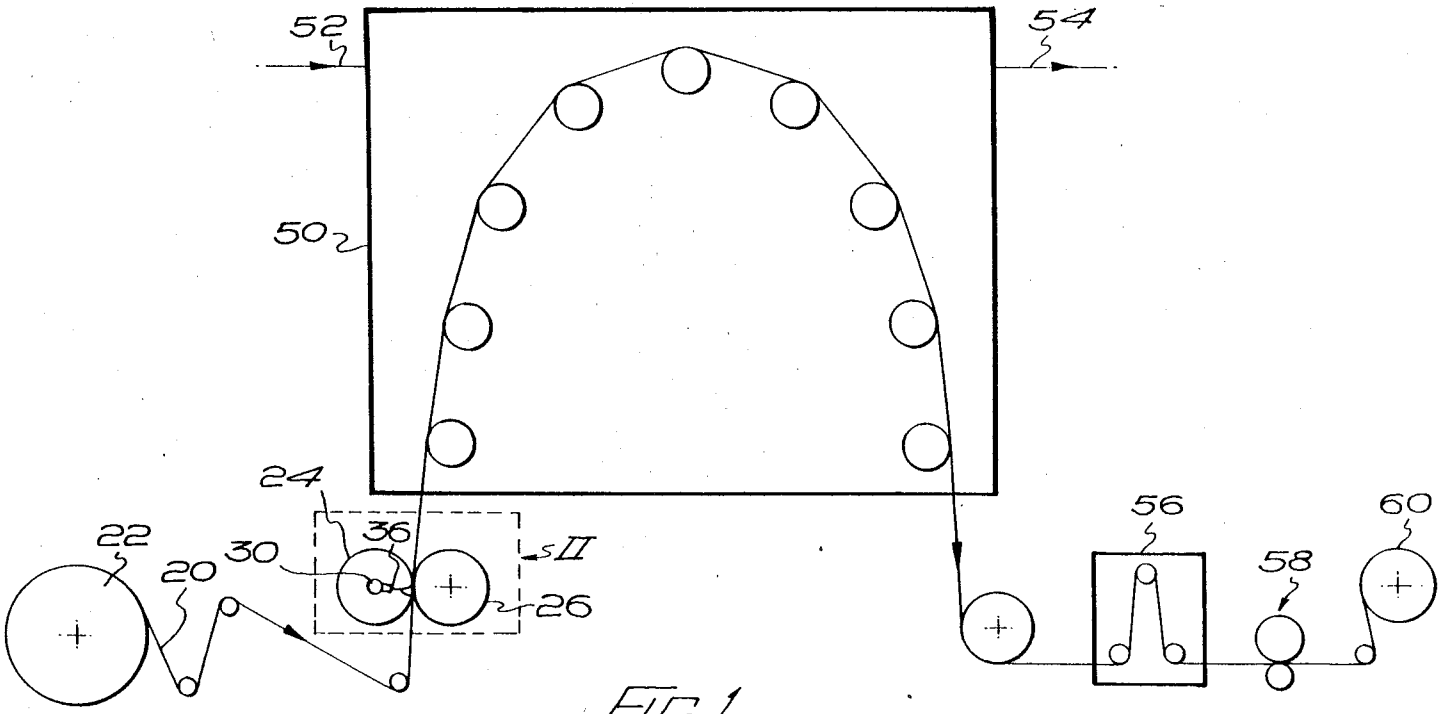
FIG. 1 is a schematic cross-section of a rotary screen printing machine for printing a raised pattern on a tipping wrapper.
Figure 2:
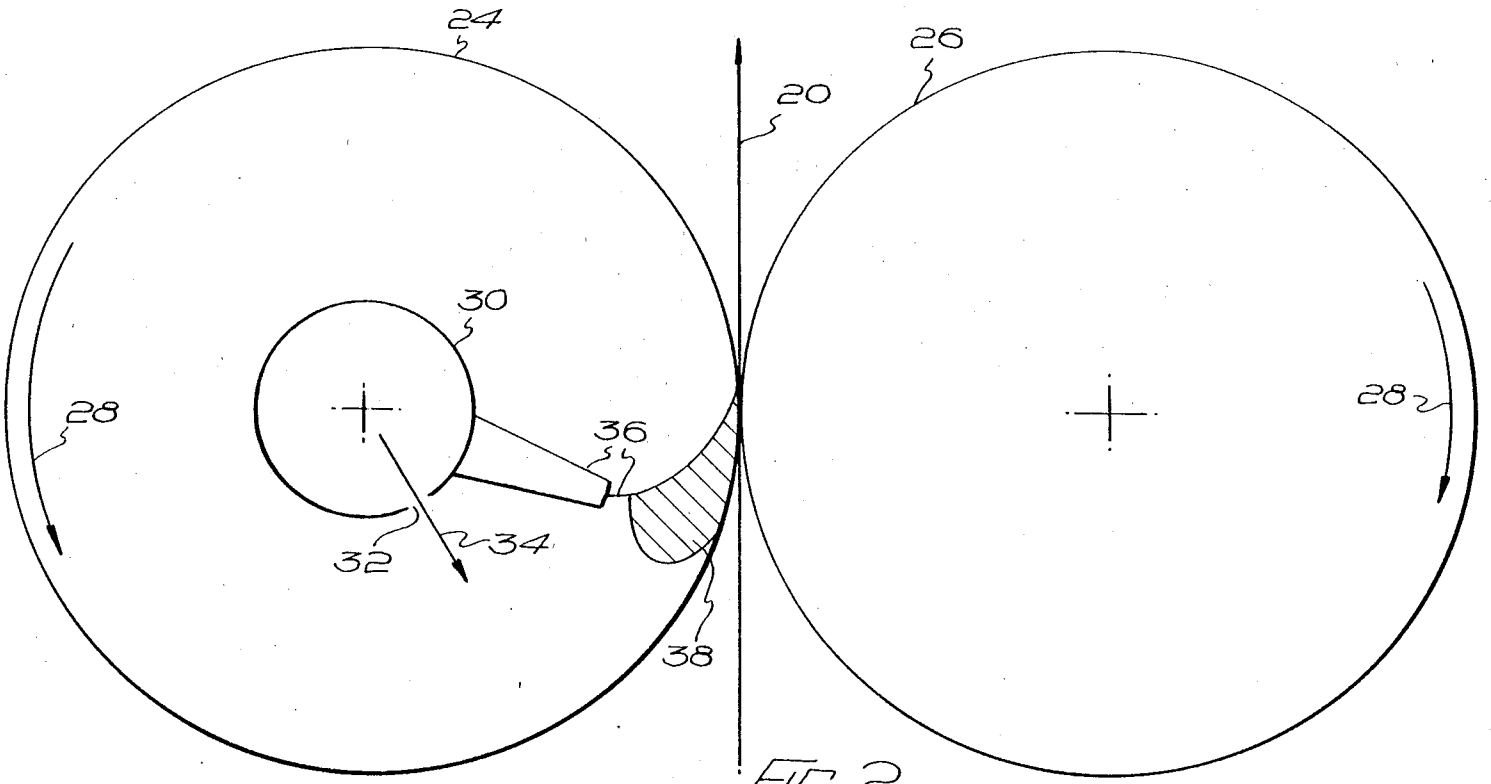
FIG. 2 is a detail enlargement of that portion of FIG. 1 enclosed in chain line II.

FIGS. 1 and 2 show a rotary screen process for printing a channel-defining pattern on tipping wrapper paper (otherwise cork tipping paper).

A web 20 of tipping wrapper paper is held prior to use on a reel 22. Tracking devices (not illustrated) are provided to control the tension of the web 20. From reel 22 the web passes to a gap between a rotary screen 24 and a backing roll 26 rotating in direction of arrows 28, where the desired pattern is deposited on the paper. The materials for deposition are typically polyvinyl acetate or polyvinyl chloride, extended with fillers, and great care must be taken with the rheological properties to ensure that an even and sharply defined deposit is formed.

The polyvinyl acetate or polyvinyl chloride printing material in fluid form is fed to the screen 24 by passing the printing material axially through a fixed hollow axle 30, round which the screen 24 rotates, radially outwards through an aperture 32 in the wall of the axle in the direction of arrow 34, and then forcing the material through the screen 24 by an adjustable squeegee 36. The material being forced through the screen 24 by the squeegee 36 is shown by the shaded area 38 in FIG. 2. By adjustment of the gap between the screen 24 and the backing roll 26, and by adjustment of the angle and pressure of the squeegee 36 the depth of the deposit may be accurately controlled.

The patterned web 20 then passes through a drying oven 50 provided with a hot air inlet and exhaust 52, 54 respectively, where the drying of the pattern is accurately controlled. After drying, the web 20 passes through a cooling section 56 and thence to a registration mark printing unit 58, such marks being required during a subsequent cigarette tipping operation. Finally, the web is wound on to a rewind reel 60 containing tension controlling and tracking devices.

The printed web may subsequently be slit on the reel to provide bobbins of required widths and diameters on a standard paper slitting machine.

Figure 4:
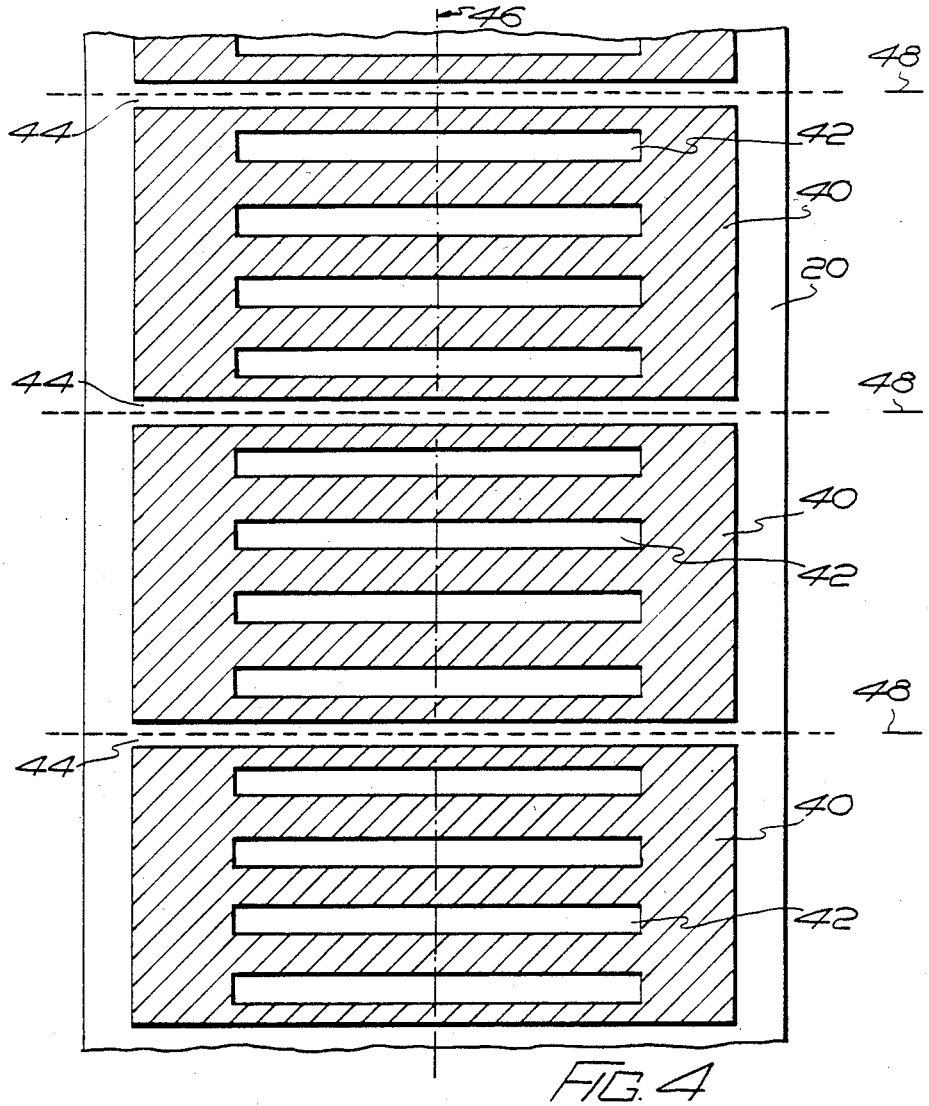
FIG. 4 is a plan view of a typical pattern printed on a tipping wrapper; and, FIG. 5 is a longitudinal cross-section of a tipping assembly using the printed tipping wrapper of the invention, and including an attached tobacco rod.

The pattern deposited as print on the web is defined by the pattern on the screen 24. A typical pattern which provides the channels 14 of FIG. 1 is shown in FIG. 4. Here the shaded areas 40 denote the material printed on the paper web 20 to a thickness of 0.005–0.03 cm and the unshaded regions 42 within the areas 40 and the unshaded parts 44 between the areas 40 being where the printing material is not deposited. By severing the printed web along lines 46 and 48 there is provided individual tipping wrappers each with four channels 14 provided by unshaded regions 42, each channel being open at one end and enclosed at the other by area 40. It will be understood that the severing along lines 46 and 48 will be carried out during the making of a filter cigarette, during and after the application of the web to the filter plug and tobacco rod, thereby to provide a tipping assembly attached to a filter rod as shown in FIG. 5.

Figure 3:
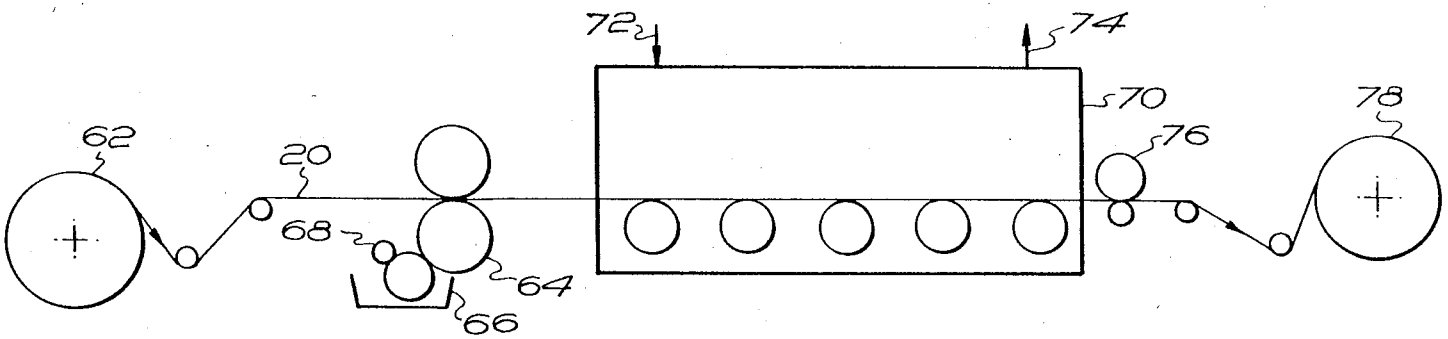
FIG. 3 is a schematic cross-section of a gravure printing machine for printing a raised pattern on a tipping wrapper.

FIG. 3 shows a gravure process for printing a channel-defining pattern on tipping wrapper paper.

A web 20 of tipping wrapper paper is held prior to use on a reel 62. Tracking devices, not illustrated, are provided to control lateral positioning of the web. Likewise, braking devices, not illustrated, are provided to control the tension of web 20. From reel 62 the web passes to a gravure roll 64 where the required pattern is deposited on to the paper. The gravure roll itself has the pattern etched on to its surface in the form of small hollows of pyramidal or similar shape. The size and depth of the hollows, plus the rheological properties of the material to be deposited (polyvinyl acetate, polyvinyl chloride, or similar), critically affects the quality and thickness of deposit achieved. The transfer of material for deposition from a reservoir 66 to the gravure roll 64 is controlled by a series of transfer and metering rolls 68.

After the deposition process the web 20 passes through a drying tunnel 70 that is provided with hot air inlet and exhaust 72, 74 respectively, where the deposit is thoroughly dried. The drying tunnel 70 may take a number of different forms and is likely to be either steam or gas heated. The drying temperature should be accurately controlled for satisfactory results. The drying tunnel may include a cooling section (not illustrated).

After drying and cooling the web 20 passes through a registration mark printing unit 76 which provides registration marks necessary for the cigarette tipping operation. The printed web is finally wound on to a rewind reel 78 containing controlling and tracking devices.

The printed web may subsequently be slit on the reel to provide bobbins of required widths and diameters on a standard paper slitting machine.

In an example the printing material used was polyvinyl chloride based and had the following composition (percentages are by weight):

| | |
|---|---|
| Liquid polyvinyl chloride | 51.4 |
| Dioctyl phthalate | 20.6 |
| Microdol I (Reg. Trade Mark) | 11.8 |
| Calcium stearate | 1.0 |
| Finnitan RF2 (Reg. Trade Mark) titanium dioxide | 8.7 |
| White spirit | 6.5 |
| | 100.0 |

Although not essential, iron oxide or similar colouring material may be added to the printing material so that the printed pattern may be readily visible on the web.

A number of different types of cigarettes made according to the invention were tested for ventilation level under standard puffing conditions, viz. one 2-second 35 ml puff per minute.

| | Ventilation Level % | |
|---|---|---|
| Cigarette Type | Mean | Standard Deviation |
| 1 | 55.3 | 8.0 |
| 2 | 50.0 | 10.0 |
| 3 | 74.9 | 6.4 |
| 4 | 51.3 | 8.2 |
| 5 | 46.4 | 11.9 |
| 6 | 62.6 | 6.4 |
| 7 | 52.1 | 8.9 |
| 8 | 48.0 | 10.9 |
| 9 | 75.6 | 5.6 |
| 10 | 58.2 | 10.1 |

It is seen that the invention enables a tipping wrapper incorporating spacing means to be produced easily and economically. Only one web of paper, viz. the tipping wrapper, is needed, and the pattern and thickness of the printed deposit (the thickness defining the spacing of the tipping wrapper from the plug wrapper) may readily be varied by changing the screen or gravure roll to suit specific requirements. It is no longer necessary to go to the expense of preparing a reel of spacing web with a required pattern of cut-outs to meet special requirements.

In other embodiments of the invention the filter element need not be wrapped in impervious plug wrapper; it may be wrapped in a pervious plug wrap or may not be wrapped at all. The invention may be applied to rods of smokeable material other than cigarette rods, such as cigarillos or cigars.

While the invention has been illustrated above by reference to the preferred embodiments, it will be understood by those skilled in the art that various changes may be made without departing from the spirit and scope of the invention, and it is intended to cover all such changes and modifications by the appended claims.

We claim:

1. A tipping assembly for an elongate smoking article including a rod of smoking material, the assembly comprising, (a) a cylindrical smoke filter element, (b) a tipping wrapper surrounding the filter element, (c) printed raised markings of platics material on the surface of the tipping wrapper facing the filter element, the markings being arranged to define in cooperation with the filter element and the tipping wrapper air channels between the tipping wrapper and the filter element extending to a mouth end of the assembly, said markings being further arranged to define means for blocking off those ends of the channels distal to the mouth end of the assembly, the mouth end of the channels being open to the user, and, (d) ventilating means in the tipping wrapper arranged to direct ventilating air through the tipping wrapper into the channels.

2. A tipping assembly as claimed in claim 1 wherein the plastics material comprises a thermoplastic resin.

3. A tipping assembly as claimed in claim 2 wherein the thermoplastic resin is selected from the group consisting of polyvinyl acetate and polyvinyl chloride.

4. A tipping assembly as claimed in claim 1 wherein the thickness of the raised marking is sufficient to provide channels 0.005–0.03 cm deep.

5. A tipping assembly as claimed in claim 1 wherein the filter element is wrapped in a plug wrapper, the plug wrapper lying between the filter element and the tipping wrapper.

6. A tipping assembly as claimed in claim 5 wherein the plug wrapper is substantially impervious to air.

7. A tipping assembly as claimed in claim 1 wherein the ventilating means are provided by a plurality of perforations in the tipping wrapper.

8. A tipping assembly as claimed in claim 1 wherein the smoking material is a rod of tobacco wrapped in cigarette paper.

9. A method of making a tipping assembly as claimed in claim 1 comprising applying by means of a printing technique a pattern of raised markings of plastics material to a web of ventilated tipping wrapper material, the pattern being arranged to define air channels extending longitudinally to and open at a mouth end only of the tipping assembly, the distal ends of the channels being closed, controlling the thickness of the markings relative to the thickness of the web to a predetermined thickness, and wrapping the printed web round a cylindrical filter element so that the pattern spaces the web radially from the filter element.

10. A method as claimed in claim 9 wherein the plastics material comprises a thermoplastic resin.

11. A method as claimed in claim 10 wherein the thermoplastic resin is selected from the group consisting of polyvinyl acetate and polyvinyl chloride.

12. A method as claimed in claim 9 wherein the printing technique comprises a rotary screen process.

13. A method as claimed in claim 9 wherein the printing technique comprises a gravure process.

14. A method as claimed in claim 9 including the step of controlling the thickness of the markings to define channels 0.005–0.03 cm deep between the tipping wrapper and the cylindrical element.

15. A method as claimed in claim 9 including the step of passing the patterned web through a drying oven or tunnel and accurately controlling the drying temperature while the web is within said oven or tunnel to dry the pattern of said markings on said web.

* * * * *